US006616083B2

(12) United States Patent
Badiali et al.

(10) Patent No.: US 6,616,083 B2
(45) Date of Patent: Sep. 9, 2003

(54) REEL-STICK DEVICE FOR WINDING YARN WITH REGULATED PRESSURE, PARTICULARLY FOR DOUBLE-TWIST TWISTING FRAMES

(75) Inventors: Roberto Badiali, Pordenone (IT); Vittorio Colussi, Cappella Maggiore (IT); Raul Panizzut, Budoia (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 0 days.

(21) Appl. No.: 09/982,602

(22) Filed: Oct. 18, 2001

(65) Prior Publication Data

US 2002/0047066 A1 Apr. 25, 2002

(30) Foreign Application Priority Data

Oct. 20, 2000 (IT) ..... MI2000A2280

(51) Int. Cl.[7] ..... B65H 63/024; B65H 54/22; B65H 54/42

(52) U.S. Cl. ..... 242/485.3; 242/485.8; 242/486.2

(58) Field of Search ..... 242/486.4, 486.2, 242/485.3, 485.8, 596.3

(56) References Cited

U.S. PATENT DOCUMENTS

| | | | | | |
|---|---|---|---|---|---|
| 3,241,778 | A | * | 3/1966 | Bourgeas | 242/486.4 |
| 4,497,451 | A | | 2/1985 | Guggemos et al. | |
| 4,576,342 | A | * | 3/1986 | Schwengeler | 242/485.1 |
| 4,635,866 | A | * | 1/1987 | Kamp et al. | 242/485.8 |
| 4,684,074 | A | * | 8/1987 | Whiteley | 242/485.9 |
| 5,018,677 | A | * | 5/1991 | Fahmuller | 242/486.2 |
| 5,409,173 | A | * | 4/1995 | Fahmuller et al. | 242/486.4 |
| 5,697,565 | A | * | 12/1997 | Zitzen | 242/486.4 |
| 6,405,967 | B1 | * | 6/2002 | Sturm et al. | 242/485.3 |

FOREIGN PATENT DOCUMENTS

| | | | | |
|---|---|---|---|---|
| DE | 633 971 | | 8/1936 | |
| DE | 29 39 612 | | 9/1980 | |
| DE | 42 31 840 | A1 | 3/1993 | |
| GB | 308759 | | 5/1929 | |
| GB | 1 561 793 | | 3/1980 | |
| JP | 60-82572 | * | 5/1985 | 242/596.3 X |

OTHER PUBLICATIONS

EP Search Report.

Patent abstracts of Japan Discloses vol. 008, No.177 (M–317), Aug. 15, 1984.

* cited by examiner

*Primary Examiner*—Kathy Matecki
*Assistant Examiner*—E Langdon
(74) *Attorney, Agent, or Firm*—Hedman & Costigan, P.C.

(57) ABSTRACT

A reel-stick arm for winding yarn with regulated pressure between the reel and its actuation roller, particularly for double-twist twisting frames, comprising automatic means for balancing the effect of weight variation of the reel being formed, means for automatic raising of the reel-stick arm, and automatic means for clamping the arm in the raised position, said raising and clamping means being co-ordinated by interlocking means.

6 Claims, 6 Drawing Sheets

-- Prior Art --

-- Prior Art --

REEL-STICK DEVICE FOR WINDING YARN WITH REGULATED PRESSURE, PARTICULARLY FOR DOUBLE-TWIST TWISTING FRAMES

BACKGROUND OF THE INVENTION

The present invention relates to the winding of yarn on reels or packages in textile machines for the preparation of yarn, and in particular relates to a device with a reel-stick arm supporting the rotating tube on which the reel of yarn is formed.

FIELD OF THE INVENTION

In industrial practice, a solution that has met with considerable success is that of actuating the tube in rotation—with the reel that is formed by winding the yarn on its surface which has the shape of a truncated cone or cylinder—by driving the said tube in rotation with an underlying motor-driven roller on which the reel itself rests, thus enabling winding of the yarn at a constant linear speed that is independent of the size of the reel, which grows as the winding operation proceeds, and dependent only upon the speed of rotation of the said actuating roller. The yarn is wound in turns on the reel and distributed with a to-and-fro motion over its generatrix by a traversing device.

BRIEF SUMMARY OF THE INVENTION

A problem linked to the winding of yarn of a reel resting on its actuating roller is due to the fact that the reel, as it grows, exerts an ever-increasing weight and applies an ever-increasing pressure on the roller, with consequences on the progress of the operation and on the mechanical and geometrical characteristics of the reel produced. For instance, the reel itself becomes more and more deformed at its point of resting as it grows. As a result, both the tension of the turns of yarn and the density of the wound layer increase. As the pressure exerted varies, the transmissible torque, especially in the speed transients, varies noticeably, and the possibility of mutual friction increases.

In order to highlight more clearly the technical problems tackled and solved by the present invention, as well as the characteristics and advantages of the invention with respect to the prior art, the said invention is here described with reference to its application in gathering units for yarn produced on double-twist twisting frames by winding it in reels, even though the device according to the invention may also find application in the entire range of machines for preparing and finishing yarn in which the yarn is wound in reels. Consequently, application of the invention is not at all intended to be limited to twisting frames alone.

BRIEF DESCRIPTION OF THE DRAWINGS

FIGS. 1A and 1B are, respectively, a side view and a front view illustrating a typical scheme of a gathering unit of a station of a double-twist twisting frame, in which the most significant members are illustrated in order to highlight the technical problem in question.

The twisting operation consists, in its main aspects, in joining together two or more threads of yarn, which are already twisted, by means of a further mutual twisting about their axis. Retwisting produces a yarn of a higher quality, greater strength and regularity, and improved appearance and "feel" as compared to the original starting yarn.

Figure 1A:
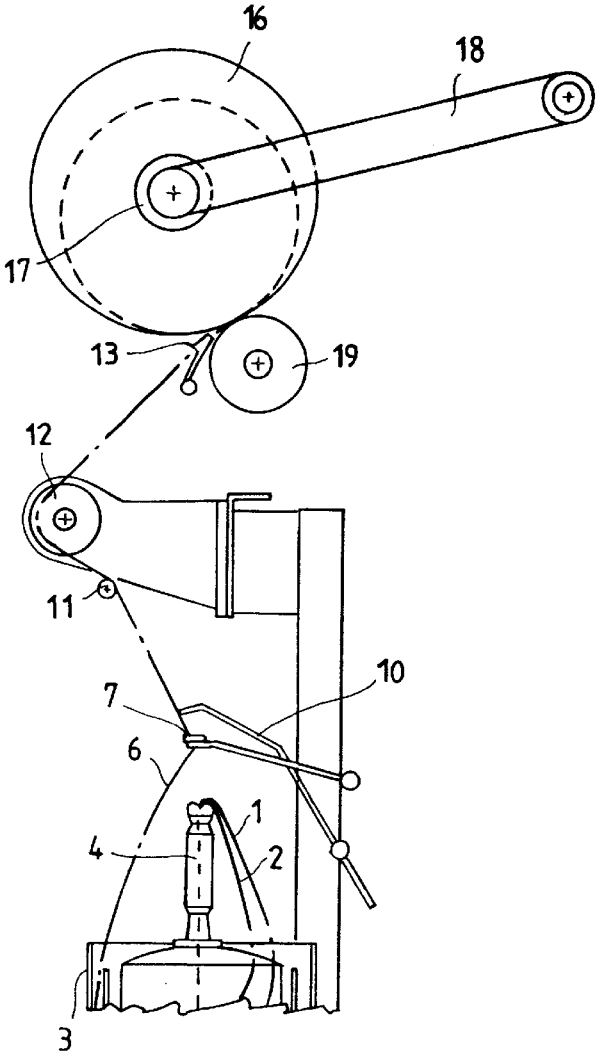
FIG. 1A is a side view illustrating a typical scheme of a gathering unit of a station of a double-twist twisting frame.
Figure 1B:
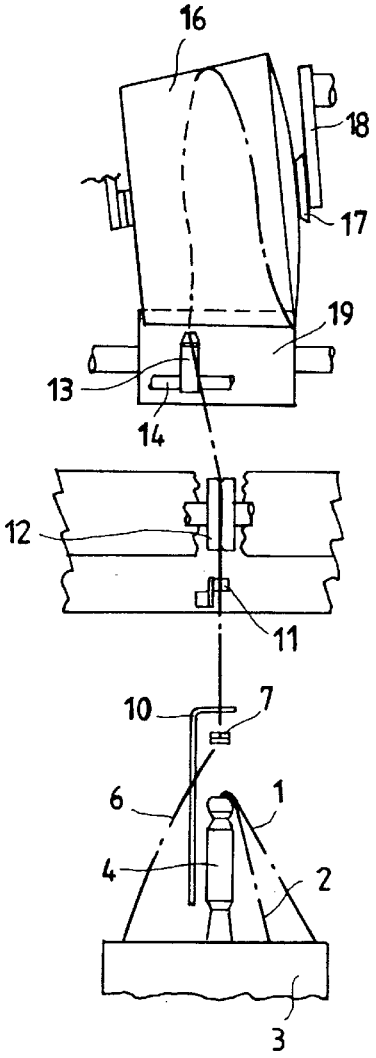
FIG. 1B is a front view illustrating a typical scheme of a gathering unit of a station of a double-twist twisting frame.

As in the case of other machines for preparing and finishing yarn, the double-twist twisting frame is made with a plurality of working units set alongside one another along one or two fronts with appurtenances, driving means and control unit that are in common. FIGS. 1A and 1B are, respectively, a side view and a front view illustrating the scheme of the basic parts of the system for gathering the thread in a twisting frame.

The supply of yarn is constituted by two threads 1 and 2, coming from the feed reels located in the underlying cylindrical basket 3, the said threads 1, 2 being inserted in the reeling-off head 4 and twisted in the bottom part of the station, which is not shown in the figure for reasons of simplicity of representation. The double-twisted yarn 6 then returns upwards, where it is gathered. The said double-twisted yarn 6 whirls, and its balloon is controlled first by the internal wall of the containment cylinder 3 and then by the yarn-guiding eyelet 7. The yarn is recalled by the pull exerted by the top reel that is being wound.

Proceeding in the direction of the reel, downstream of the yarn-guiding eyelet 7, the yarn 6 then encounters a yarn-feeler 10, an idler wheel or pulley 11, and the drawing mechanism or tractor 12. The said tractor consists of two rotating plates or cups set facing one another to form a tortuous groove that engages and pulls the tensioned yarn so as to divide the action of tension between the tractor and the reel. In normal operating conditions, the twisted yarn 6 then passes from the yarn guide 13, which distributes it over the generatrix of the reel with a driven to-and-fro motion along the guide 14.

The reel 16 of yarn being formed, which recalls and gathers the retwisted yarn 6, is wound on the base tube 17, which is also carried by a reel-stick arm 18, and is driven in rotation by a cylinder or roller 19 rotating at a constant speed. The reel-stick arm consists, in its essential features, of a liftable fork and two jaws which open with respect to one another in order to open and close two centring shafts or supports that block the tube on which the yarn is wound to form the reel. As gathering of the yarn proceeds, the reel 16 rotates resting on the roller 19, increasing its diameter and decreasing its angular velocity. The reel increases in weight and volume, and the arm 18 lifts up gradually. The reel is exposed to the phenomena described in the preamble of the present description as a result of its variation in size.

If the yarn 6 is interrupted either because it breaks or because it runs out, even in the sense that just one of the two feed threads runs out, the yarn-feeler 10 drops, rotating about its shaft, causes the arrest command from the control unit, and activates the alarm for the operator. It must in fact be borne in mind that, in the absence of one of the threads, the surviving thread is considerably weakened in that it is in conditions of untwisting, and hence does not withstand the tensile force and thus breaks.

DETAILED DESCRIPTION OF THE INVENTION

The characteristics and advantages of the device according to the present invention emerge more evidently from the description of a typical embodiment thereof, which is provided by way of non-limiting example, with reference to FIGS. 2 to 5.

Figure 2A:
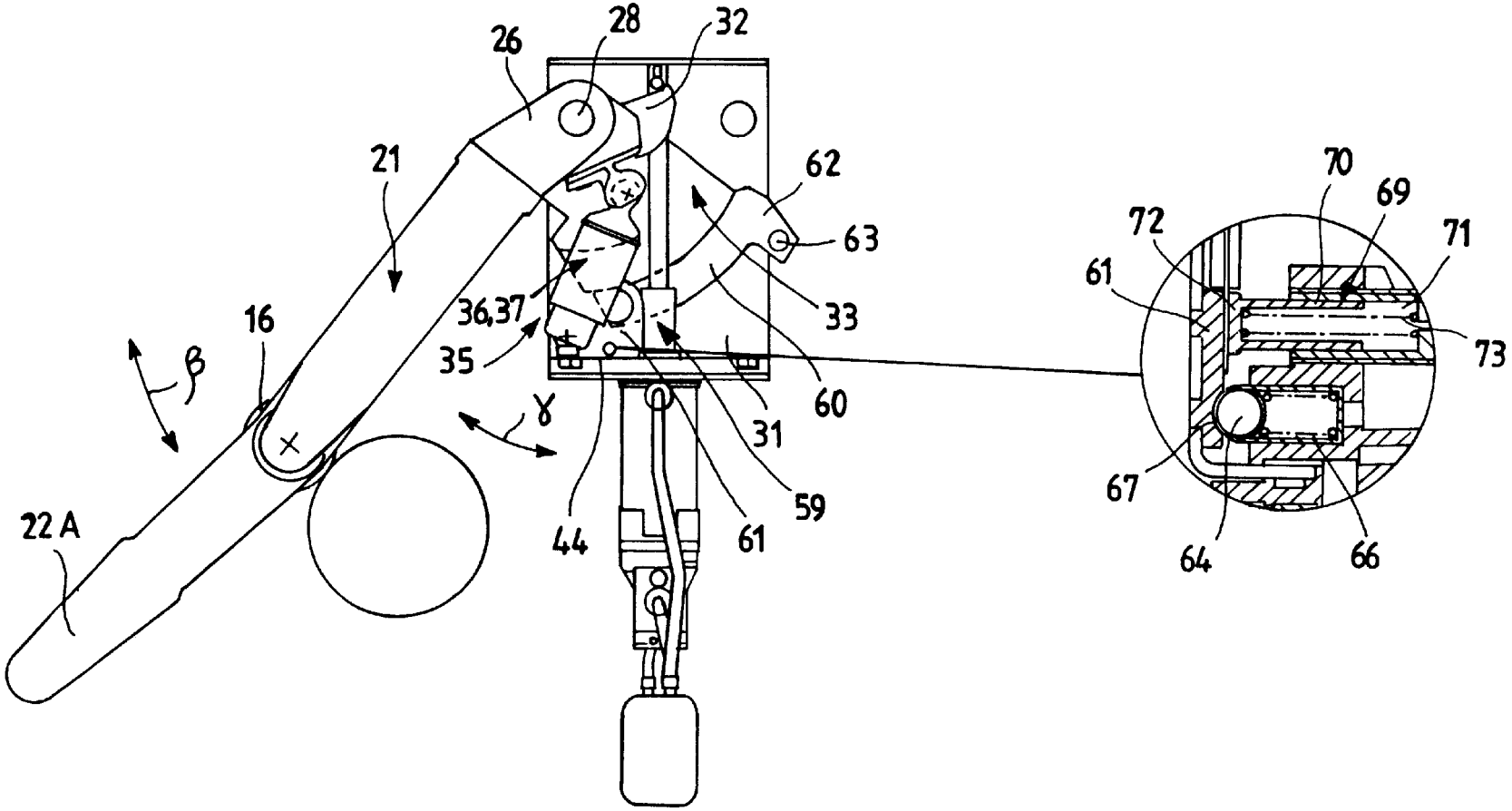
FIG. 2A illustrates the reel-stick arm assembly in its configuration with the reel at the start.
Figure 2B:
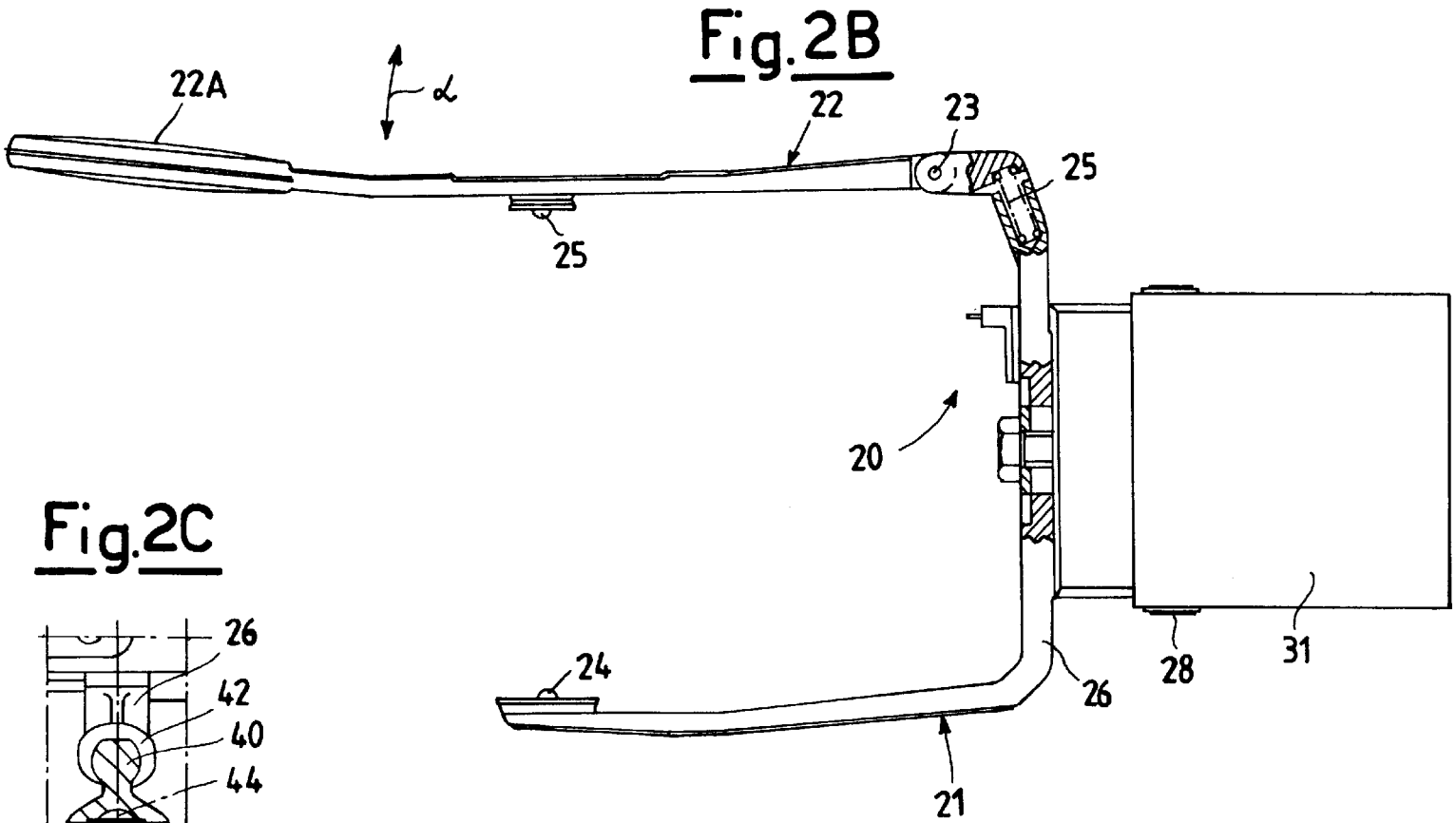
FIG. 2B illustrates a top view of the reel-stick arm assembly fork.
Figure 2C:
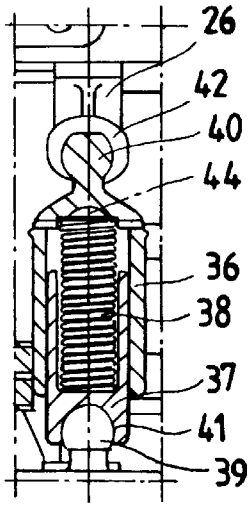
FIG. 2C illustrates a sectional view counter-weighting device.
Figure 3:
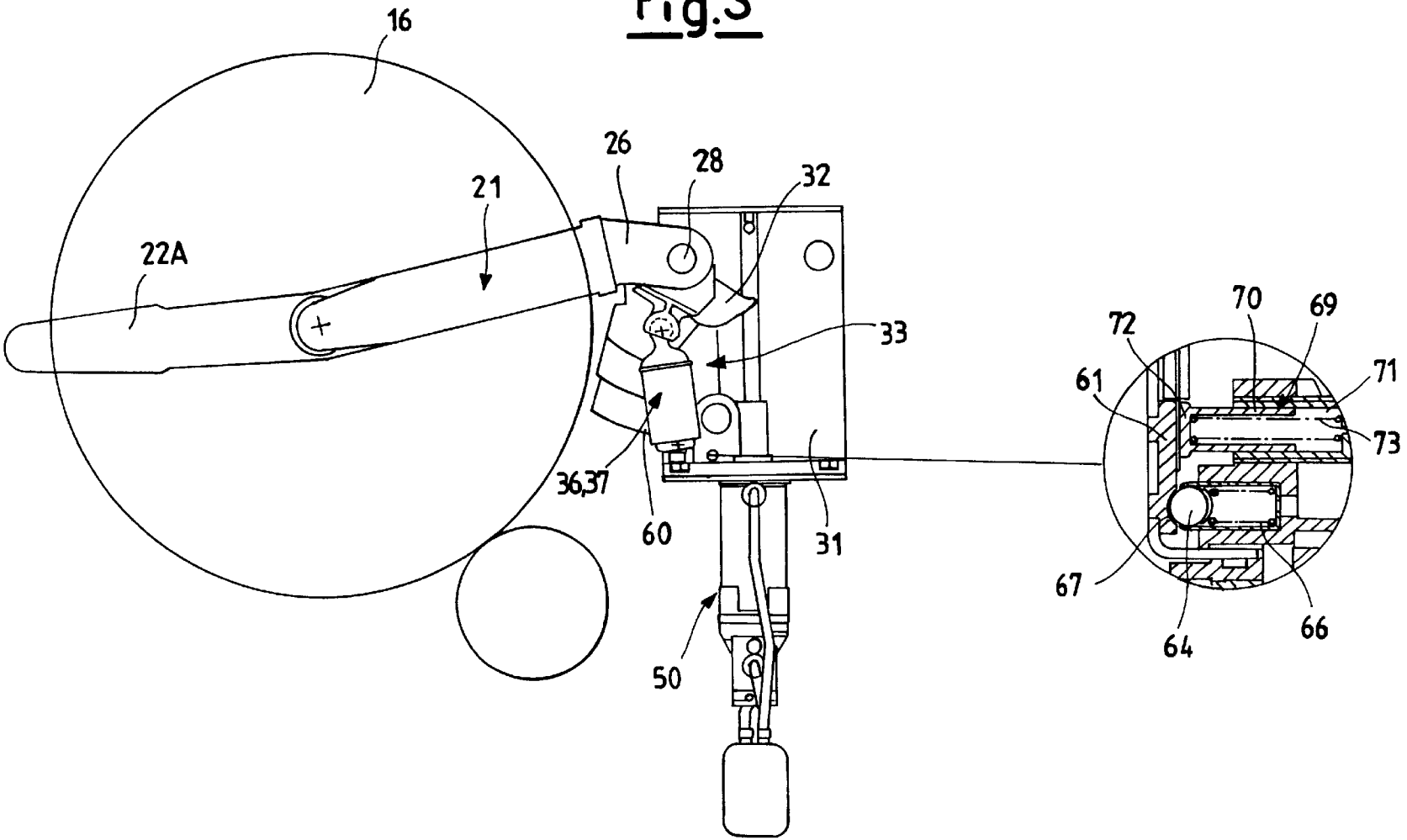
FIG. 3 illustrates the reel-stick arm assembly in its configuration with the reel about to be completed.
Figure 4:
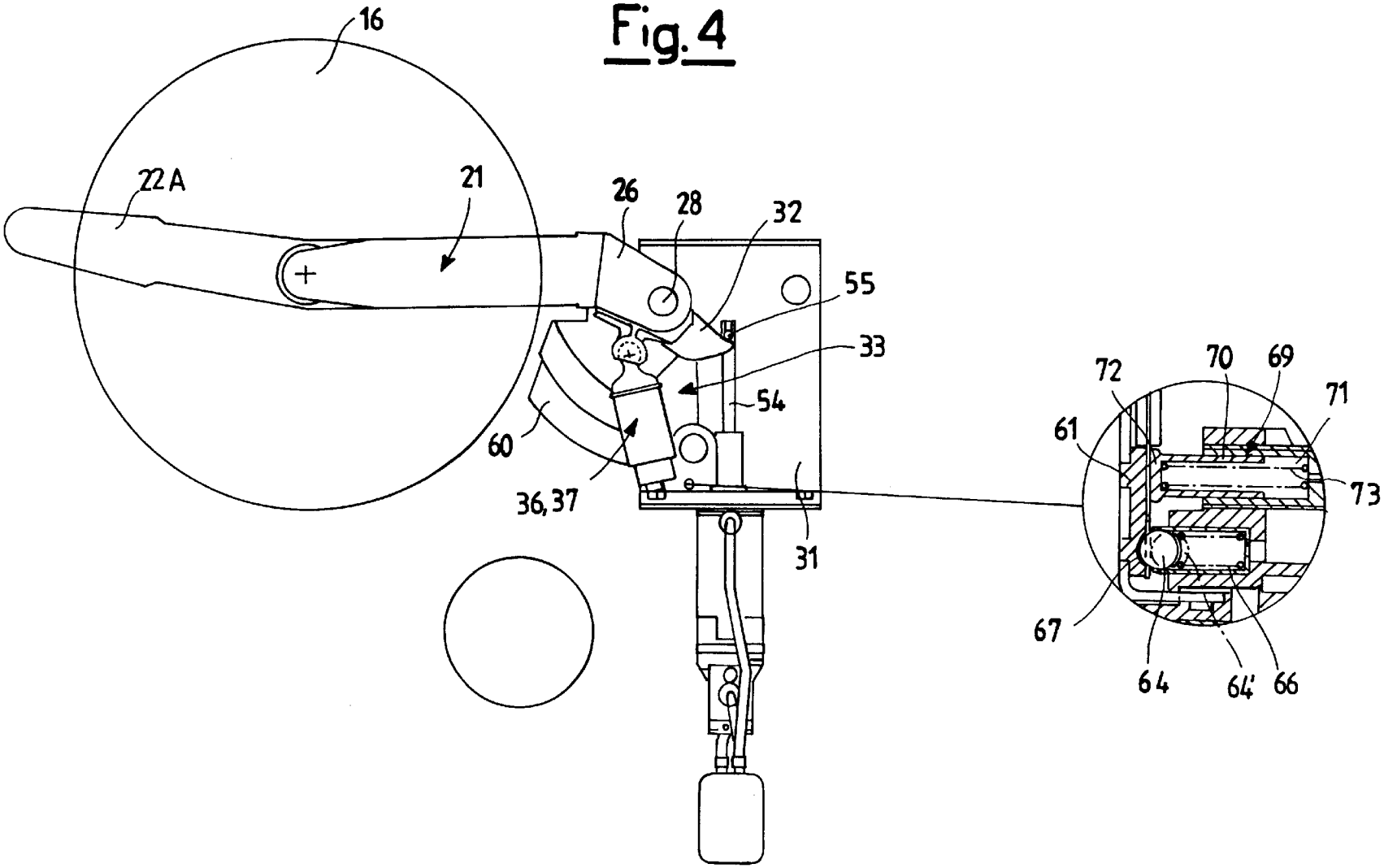
FIG. 4 illustrates the reel-stick arm assembly in its configuration with the reel raised by intervention or reel completion.
Figure 5:
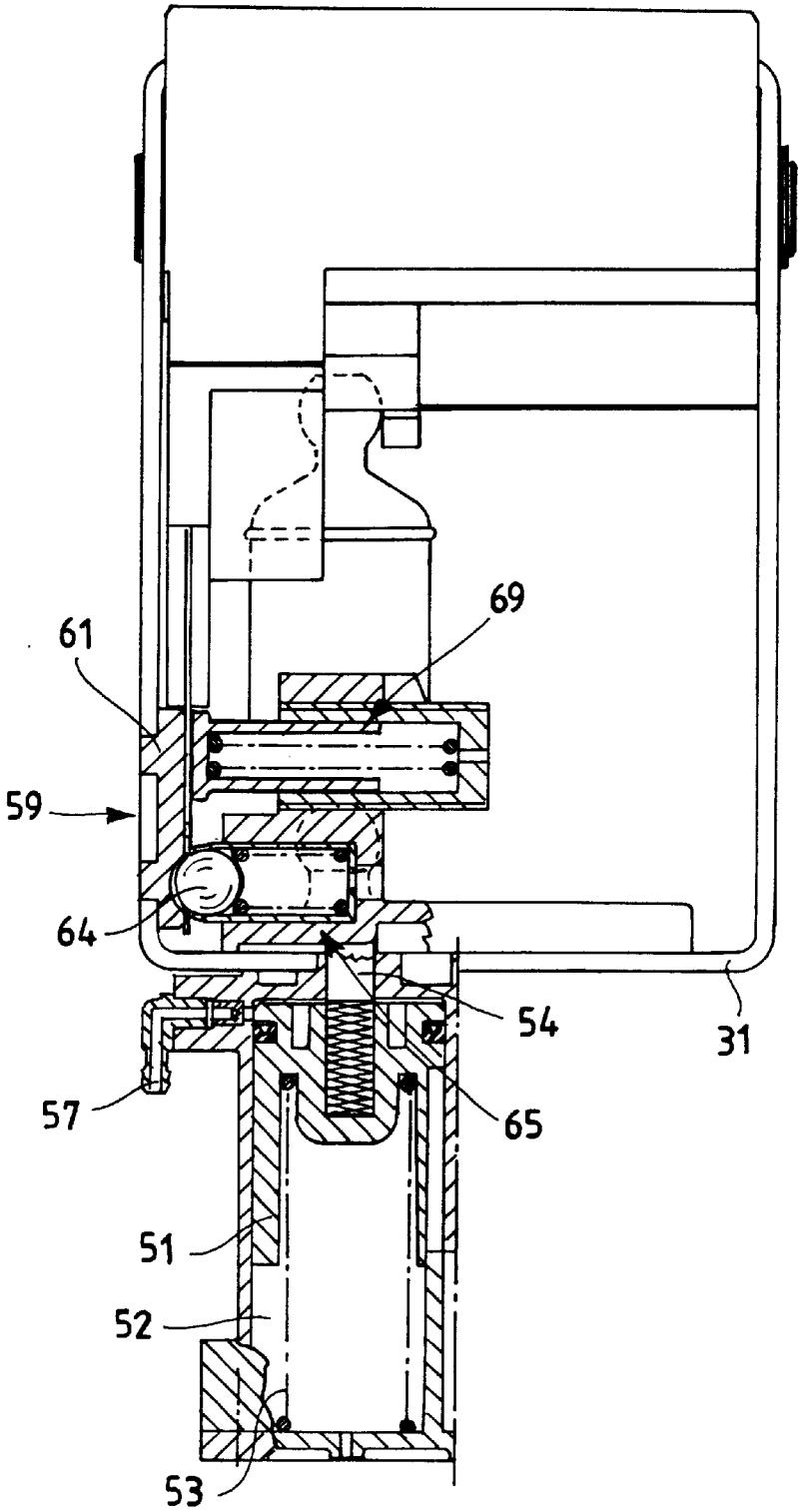
FIG. 5 is a sectional view of the reel-stick arm assembly illustrating the components of the raising device.

FIGS. 1A and 1B illustrate the scheme of gathering of the yarn in a double-twist twisting frame, to which the reel-stick arm is applied by way of example. FIGS. 2A–C illustrate, instead, the reel-stick arm according to the present invention in its configuration with the reel at the start, with regard to the structure and operation of said arm. FIG. 3 illustrates, instead, the reel-stick arm according to the present invention in its configuration with the reel about to be completed. FIG. 4 illustrates the reel-stick arm according to the present invention in its configuration with the reel raised on account of an intervention or on account of reel completion. FIG. 5 is a sectional view with details of the reel-stick arm illustrating the components of the raising device, the clamping device, and the device for damping the reel-stick arm.

FIGS. 2A, 3 and 4 are provided with enlarged details of the main components of the devices for counter-weighting, lifting, clamping, and damping with which the reel-stick arm is provided.

FIG. 2A is a side view of the reel-stick arm, and FIG. 2B is a top view thereof. The reel-stick arm is made up of a fork 20 formed by two arms 21 and 22, one of which—in FIG. 2A the arm 22—is hinged in 23 and can open and close the fork 20 according to a rotation $\alpha$ for inserting or removing the base tube 17 on which the reel is formed into/from its gripping position between the two centring shafts 24 and 25. Opening the fork 20 is countered by pulling or tension spring 25A, which tends to grip the ends of the tube between the two arms. The arm 22 is provided with an extension 22A which enables the operator to grip it for opening and closing the fork 20, as well as for raising and lowering the reel—stick arm manually.

The base 26 of the fork 20 orthogonal to the arms 21, 22 is hinged so as to enable a rotation $\beta$ about a substantially horizontal pin 28 to raise and lower the reel-stick-arm assembly. The pin 28 is constrained to the fixed structure 31 of the twisting frame. On the opposite side, the base of the fork 26 is provided with a lever arm 32 for the raising device, which will be illustrated in what follows. The base 26 of the fork 20 orthogonal to the arms 21, 22 is moreover equipped with a circular sector 33 for the device for clamping the raised reel-stick arm, which is likewise described in what follows.

The base 26 of the fork 20 is further provided with counter-weighting means 35 which enable the effect of the increasing weight of the reel to be countered and the pressure between the reel 16 and the roller 19 to be kept within pre-set values. This device is made up of two coaxial hollow pistons 36, 37 which slide with respect to one another and contain a compression spring 38, which tends to move them away from one another. The structure of the two pistons is illustrated in the cross-sectional view of FIG. 2C. The two pistons 36, 37 are respectively provided with ball-and-socket joints 39, 40 at their ends, which are constrained with male and female spherical couplings 41, 42, respectively to the fixed structure 31 of the twisting frame and to the base 26 of the fork 20. The couplings of the pistons are exemplified, in the embodiments shown herein, as ball-and-socket joints, but they could be obtained even with different types of constraint, for example as cylindrical articulated joints.

Operation of the counterweighting device 35 is described in what follows. In the configuration of FIG. 2A, the reel wound on the tube still has a small diameter, and the arms 21, 22 of the fork are in the relatively lower position. In this configuration, the direction of the axis 44 of the two coaxial pistons passes on the right, i.e., inside the pin 28. The thrust of the compressed spring 38 inside the pistons thus results in a supplementary weight which causes the reel 16 to weigh against the roller 19. The thrust of the spring 38 is thus added to the small weight of the reel in the initial phase. As the diameter of the reel 16 increases, the direction of the axis 44 of the pistons 36, 37 turns according to the rotation $\gamma$ about the centre of the ball-and-socket joint 39 and approaches the centre of the pin 28, thus reducing the arm of the thrust of the spring 38 and the pressure exerted on the roller 19, until it vanishes when the direction of the axis 44 of said pistons passes through the centre of the pin 28.

When the direction of the axis 44 of the pistons 36, 37 has passed through the centre of the pin 28 and moves to the left, i.e., outside the pin 28, so assuming the configuration of FIG. 3, the thrust of the compressed spring 38 in said pistons thus results in a force that opposes the weight exerted by the reel 16 and reduces the pressure on the roller 19. From this moment, as the diameter of the reel increases, the direction of the axis 44 of the pistons 36, 37 moves further and further away from the centre of the pin 28, thus increasing the arm of the thrust of the spring 38 and the action of counter-weighting, i.e., the action of reducing the pressure exerted on the roller 19 by the weight itself of the reel that is being completed.

The values of the range of pressure that it is intended to apply between the reel and the actuating roller, as well as the value of the diameter of the reel at which the action of the counter-weighting device 35 is reversed, can be adjusted by intervening both on the geometry of the system and on the calibration of the spring 38. The said adjustment means may intervene advantageously on the position of connection of the ball-and-socket joints 39, 40, for example on the position in which the joint 39 is fixed to the fixed structure, thus varying the diameter of the reel at which reversal of the action of the counter-weighting device 35 occurs.

When the reel has reached the desired length, i.e., the pre-set size, the finished reel 16 is removed and replaced by a new tube 17. In order not to damage winding of the yarn, the reel 16 is made to stop by raising it beforehand from its actuating roller 19. The procedure is much the same also when an intervention is to be carried out during production of the reel of yarn, for example when twisting is interrupted because the yarn-feeler 10 drops and signals interruption of the yarn 6. To detach the reel from its roller, there is the automatic lifting member 50, which consists of a cylindrical piston 51 operated by fluid means, for example pneumatically, that slides in an underlying cylindrical chamber 52. In the embodiment illustrated in FIGS. 4 and 5, the said pneumatic actuator is a single-acting one, the return into the working position being entrusted to the contrasting action of a compression spring 53 set inside the chamber 52. Connected to the piston 51 is a vertical stem 54 which carries an engagement member, for example a projecting pin or roller 55, designed to grip the end of the lever arm 32 set opposite to the fork 20. With introduction of fluid under pressure by means of the duct 57, the piston 51 is lowered, so compressing the spring 53 and withdrawing the stem 54 with the roller 55. In its travel downwards, the said roller intercepts the end of the lever arm 32 and lifts the entire reel-stick-arm assembly, with its reel 16 wound, with a rotation β about the pin 28. According to a preferred embodiment, opening of the valve and entry of the fluid into the cylindrical chamber 52 is directly interlocked to dropping of the yarn-feeler 10.

The rotation β also involves the circular sector 33, which is integral with the base 26 of the reel-stick arm and which carries an automatic device 59 for temporary blocking of the reel-stick arm in the raised position, which is illustrated also with reference to the details of FIGS. 2A, 3, 4, and 5.

The circular sector 33 consists of a plate which describes the arc of a circle 60 and which is rendered integral with the base 26 of the fork 20 and rotates with the latter, resting against the contrast surface of a fixed shoulder 61 that is integral with the fixed structure 31 of the twisting frame. At its innermost end, the plate 60 has an appendage 62 having a circular through hole 63 which serves as point of engagement for the terminal ball 64 of the moving element of a device 65 for clamping the reel-stick arm, also this device being integral with the fixed structure 31 of the twisting frame and being subject to the thrust of a spring 66 against the through hole 63 and a spherical seat 67 made in the fixed shoulder 61. The said clamping is performed when the rotation β first brings the appendage 62 of the plate 60 to be inserted and to displace said ball 64 from its seat 67, into the position 64' of FIG. 4, as defined by the dashed-and-dotted-line, in such a way that said appendage 62 continues to rotate until its hole 63 comes to correspond with the ball 64 and to enable the ball 64 to be re-inserted into its seat 67, so gripping the appendage 62 and the plate 60, thus carrying out temporary clamping of the reel-stick arm in a raised position. Once the reel-stick arm is clamped, the piston 51 and the stem 54 can be lifted up again independently of resetting of the arm itself.

Operation of the lifting and clamping members is appropriately provided with means of interlocking and co-ordination, both by controlling lifting interlocked to the dropping of the yarn-feeler 10 and by controlling interruption of lifting of the reel-stick arm when clamping occurs. For instance, for this purpose the sector 33 is equipped with angular-coordinate sensors which enable the control unit of the machine to interrupt introduction of fluid into the chamber 52 in due time, or else the seat 67, which the terminal ball 64 moves away from or up to, is provided with sensors.

The angular value of lifting of the reel-stick arm according to the rotation β at which clamping occurs may be adapted and adjusted, for instance by modifying the mutual position between the plate 60 and the base 26 of the fork 20.

With the reel-stick arm raised, braking and arrest of the reel can be performed without any problems, and likewise the other operations required from the operator, who, when he arrives, finds the arm raised and the reel 16 already separate from the roller 19. The arm can be reset to cause the reel, or the new tube, to return into contact with the roller 19 after it has raised the stem 54 again, releasing the pressure in the chamber 52 and enabling release of the spring 53, which brings the piston 51 back up. The arm can then be lowered again by the operator by overcoming the resistance of the spring 66 with the lever 22A, with a force sufficient to cause the clamping ball 64 to move back from its habitual seat 67.

According to a further improved embodiment of the invention, a device 69 for damping the vibrations or oscillations of the reel-stick arm due to the irregularities of the twisting operation is applied, again on the circular sector 33 that is integral with the base 26 of the fork 20, or else on the plate 60. This device consists of a piston 70 which can slide within a chamber 71 that is integral with the fixed structure 31 of the twisting frame and which is pushed at its end 72 by a spring 73 against the plane surface of the plate 60, compressing it against the fixed shoulder 61, so as to exert an action of friction and damping of the said stresses which adversely affect the quality of the twisted yarn and the finished reel. According to a preferred embodiment of the invention, the pressure exerted by the spring 73 is appropriately adjusted, for example by a calibration screw, for imparting the desired damping action.

The reel-stick arm according to the present invention enables the problems described previously to be overcome both in the course of normal winding of the reel and in the course of interventions in which there are stops, starts, and transient operating conditions.

The reel-stick-arm device enables winding of a package as well as any intervention of the operators, safeguarding the quality of the yarn and of the wound package, which, especially in the twisting processes, is required to be of the highest level.

The device may moreover be adjusted in such a way as to exert a winding pressure between the reel 16 and the actuation roller 19 within a pre-determined range that is independent of the state of advance of the reel. This enables the preparation of stable reels having uniform and pre-determined densities.

What is claimed is:

1. A reel-stick arm assembly for winding yarn on twisting frames having an adjusted pressure between a reel (16) and a driving roller (19) rotating at a constant linear speed, comprising a fixed structure (31) integral with: a counter-weighting means (35) which counterbalances the effect of the variation in weight of the reel of yarn being formed; a means (50) for automatic raising of said reel-stick arm assembly; an automatic clamping means (59) for temporary blocking of said reel-stick arm assembly in a raised position and vibration-damping, said means (50) for automatic raising and said automatic clamping means (59) being coordinated together by interlocking means, and said automatic clamping means (59) contacting a circular sector (33) rendered integral with a base (26) of a fork (20) of said reel-stick arm assembly, which rotates with said fork (20), said circular sector (33) further comprising a plate (60), which is in contact with a fixed shoulder (61) and said automatic clamping means (59), both integral with said fixed structure (31) of said reel-stick arm assembly, and said plate (60) having an appendage (62) with a hole (63) that serves for engagement of a terminal end (64) of a mobile element of a device (65) within said automatic clamping means (59) for clamping said reel-stick arm assembly and a seat (67) that is integral with said fixed shoulder (61) within said fixed structure (31) of said reel-stick arm assembly.

2. The reel-stick arm assembly according to claim 1, charcterized in that said automatic clamping means (59) further comprises a vibration-damping device (69) for damping the vibrations of the reel-stick arm assembly, said vibration-damping device (69) in turn comprising a piston (70) having an end (72) pushed against the plane surface of said plate (60), thus compressing said plate against said fixed shoulder (61).

3. The reel-stick arm assembly according to claim 1, characterized in that the means (50) for automatic raising up said reel-stick arm assembly comprises a piston (51) actuated by motor fluid that flows in a chamber (52), to which an engagement means (55) is connected that is designed to grip a lever arm (32) which is integral to and opposite said fork (20) of said reel-stick arm assembly.

4. The reel-stick arm assembly according to claim 3, characterized in that the means (50) for automatic raising up said reel-stick arm assembly comprises a single-acting actuator (51, 52), which returns to a working position by the countering forces of a compression spring (53) located inside said chamber (52).

5. The reel-stick arm assembly according to claim 1, characterized in that the means (35) for counter-weighting said reel-stick arm assembly comprises two coaxial hollow pistons (36, 37) which slide with respect to one another and contains a compression spring (38) which tends to move said coaxial hollow pistons (36, 37) away from one another, and having articulated joints (39, 40) at opposite ends that are constrained with couplings (41, 42) respectively to said fixed structure (31) of said reel-stick arm assembly and to said base (26) of said fork (20).

6. The reel-stick arm assembly according to claim 5, characterized in that the means (35) for counter-weighting said reel-stick arm assembly further comprises adjustment means that intervene on said position of connection of said articulated joints (39, 40), thus changing the reel diameter at which reversal of the action of said counter-weighting means (35) takes place.

* * * * *